United States Patent [19]

Schell

[11] 4,406,512

[45] Sep. 27, 1983

[54] TRIPLE ROW COAX CABLE CONNECTOR

[75] Inventor: Mark S. Schell, Palatine, Ill.

[73] Assignee: E. I. Du Pont de Nemours and Company, Wilmington, Del.

[21] Appl. No.: 286,557

[22] Filed: Jul. 24, 1981

[51] Int. Cl.[3] ..... H01R 17/04

[52] U.S. Cl. ..... 339/177 R

[58] Field of Search ..... 339/14 R, 103 R, 103 M, 339/143 R, 177 R, 177 E

[56] References Cited

U.S. PATENT DOCUMENTS

| | | | |
|---|---|---|---|
| 3,864,011 | 2/1975 | Huber | 339/103 M |
| 3,954,321 | 5/1976 | Casper | 339/177 R |
| 3,958,852 | 5/1976 | Abraham | 339/177 R |
| 3,963,319 | 6/1976 | Schumacher et al. | 339/176 MF |
| 4,035,050 | 7/1977 | Volinskie | 339/99 R |
| 4,040,704 | 8/1977 | Huber | 339/99 R |
| 4,169,650 | 10/1979 | Schweizer | 339/177 R |

*Primary Examiner*—Joseph H. McGlynn

[57] ABSTRACT

A triple row coax cable connector providing a pluggable interface between a printed circuit board and a pair of coaxial cables. Signal wires connect to a terminal within the connector after their poly(tetrafluoroethylene) jackets are pushed back by a funnel shaped member. Drain wires are soldered to strain relief bars projecting through holes in a metal plate separating the funnel shaped members.

8 Claims, 10 Drawing Figures

TRIPLE ROW COAX CABLE CONNECTOR

FIELD OF THE INVENTION

This invention relates to electrical connectors used with coaxial cable. More particularly, it refers to a three row connector for shielded coaxial ribbon cable having a single signal and at least one drain wire in repeating sequence.

BACKGROUND OF THE INVENTION

Recent improvements in the development of processes for making coax cable such as set forth in U.S. Pat. No. 4,187,390, have created the need for connectors of advanced design to provide means of terminating these new coax cables. The coax cables are of the type comprising an inner conductor, an insulating jacket of porous poly(tetrafluoroethylene) tape wrapped around the conductor, at least one drain wire adjacent the insulating jacket and an outer metallic shield. A dielectric covering encloses the metallic shield.

Electrical coax cable connectors known to the art such as set forth in U.S. Pat. Nos. 3,864,011, 3,963,319, 4,035,050 and 4,040,704 will not easily and cheaply terminate cable such as described in the aforementioned U.S. Pat. No. 4,187,390.

SUMMARY OF THE INVENTION

I have now designed an improved triple row coax cable connector providing a pluggable interface between a printed circuit board and a pair of ribbon coaxial cables. Ground conductors are connected to a central metal bar providing an attachment for strain relief clamps. The signal wires are located on either side of the metal bar and are led into funnel shaped openings to mate with standard female type terminals located outside the narrowest end of the funnels.

BRIEF DESCRIPTION OF THE DRAWINGS

FIG. 3—Assembled sectional view of connector and housing.

DESCRIPTION OF THE BEST MODE

Figure 1:
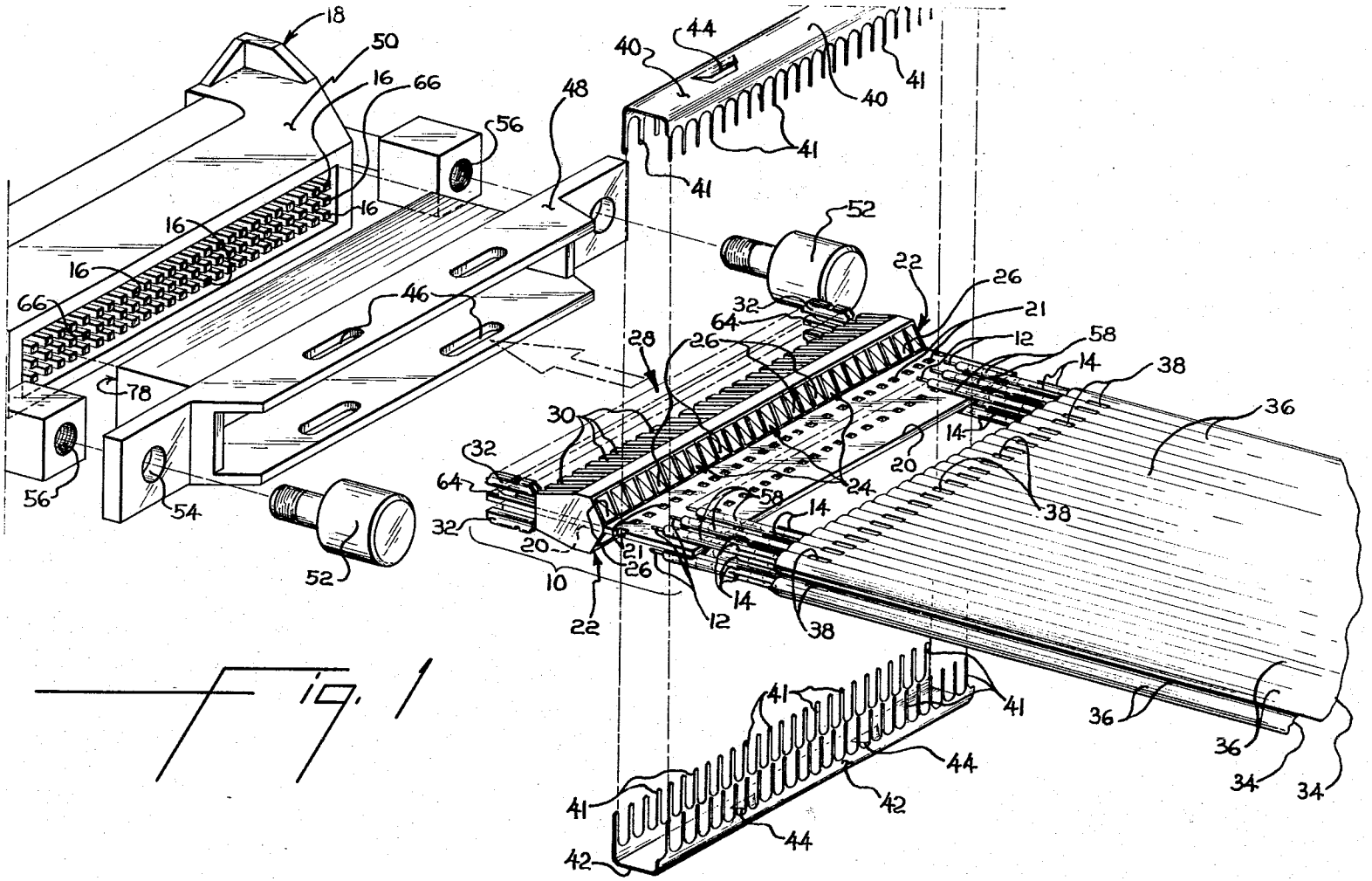
FIG. 1—Exploded prospective of connector and housing shell.

An electrical connector 10 provides a means of contacting signal wires 12 and drain wires 14 to the pins 16 and 66, respectively, of a three row header 18.

A metal ground plate 20 is insert molded between two wire receiving dielectric funnel shaped members 22. If a two row connector is desired the ground plate 20 need only be molded to a single dielectric member. The entrance end 24 contains wide mouth openings 26 for receiving signal wires 12 and the poly(tetrafluoroethylene) tape 58 from the coax cables 34. Exit end 28 contains multiple terminal receiving slots 30. Each slot 30 contains a female terminal 32.

The coax cable 34 has an outer insulation layer 36. This layer is penetrated with holes 38 adapted to receive ground strain relief bars 40 and 42. Each strain relief bar 40 or 42 contains latches 44 capable of engaging slots 46 in a housing shell 48 which fits over the connector 10. The housing shell 48 containing the connector 10 is attached to the shroud 50 of the three row header 18 by means of jack screws 52. Holes 54 in the housing shell 48 and holes 56 in the shroud 50 accommodate the jack screws 52.

The coax cable 34 is prepared for the connector 10 by first punching holes 38 between each repeating unit of signal wire 12 and ground wires 14. Then the end of the insulation 36 is stripped to expose a poly(tetrafluoroethylene) jacket 58.

Figure 2:
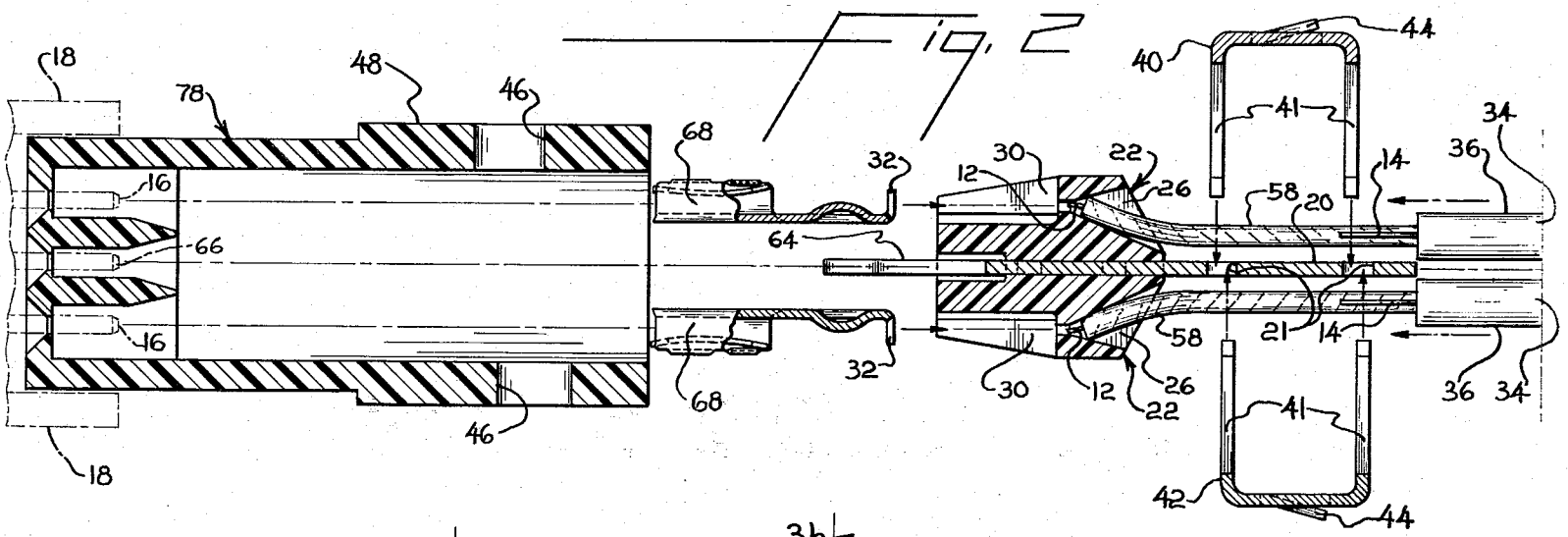
FIG. 2—Exploded sectional view of connector and housing shell.
Figure 1:
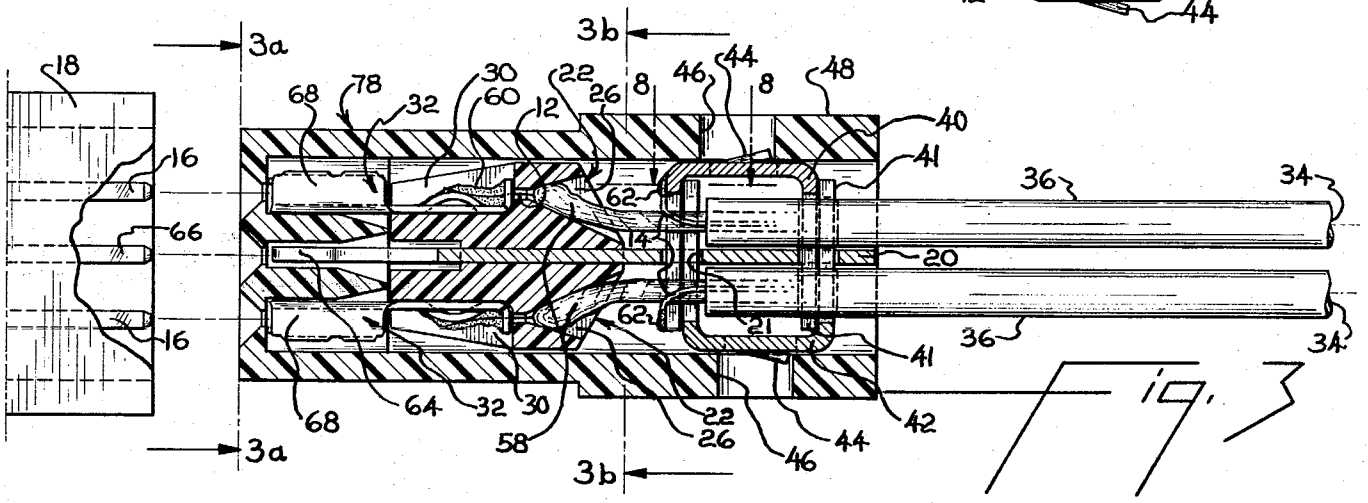

As shown in FIGS. 2 and 3, the signal wire 12 surrounded by the poly(tetrafluoroethylene) jacket 58 is inserted into the wire receiving funnel entrance end 24 through the mouth openings 26. The diminishing cross section of the channel within the funnel 22 retains the poly(tetrafluoroethylene) jacket 58 and the wire 12 proceeds through the channel to the exit end 28 of the funnel member 22 to engage a terminal 32 retained within the slots 30.

The wire 12 is soldered in zone 60 to the terminal 32. The ground wires 14 are soldered in zone 62 to the bars 40 and 42, respectively, as shown in FIG. 3. The ground plate 20 has a pair of tuning forks 64 on the end opposite from the solder zones 62. The tuning forks 64 engage a middle pin 66 in the three row header 18. The top and bottom row of pins 16 in the header 18 engage female end 68 within the terminal 32.

Figure 4:
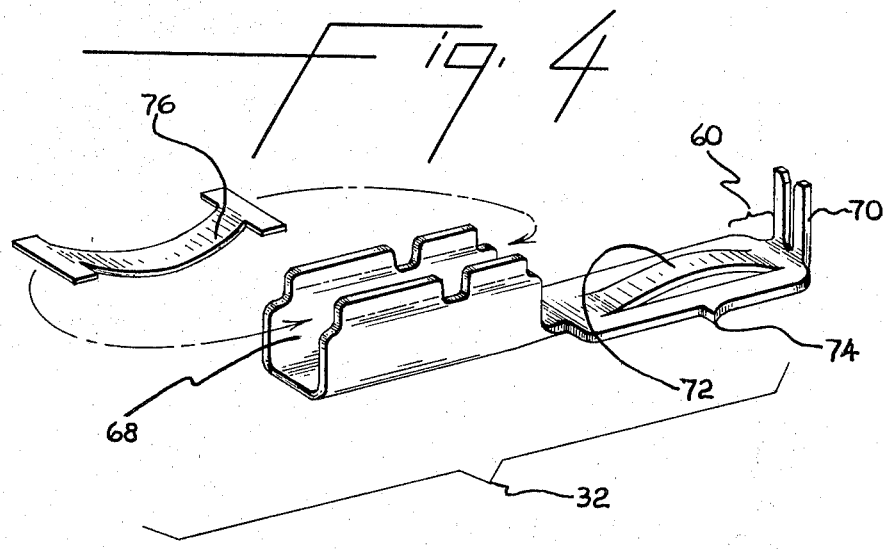
FIG. 4—Exploded prospective of terminal.
Figure 5:
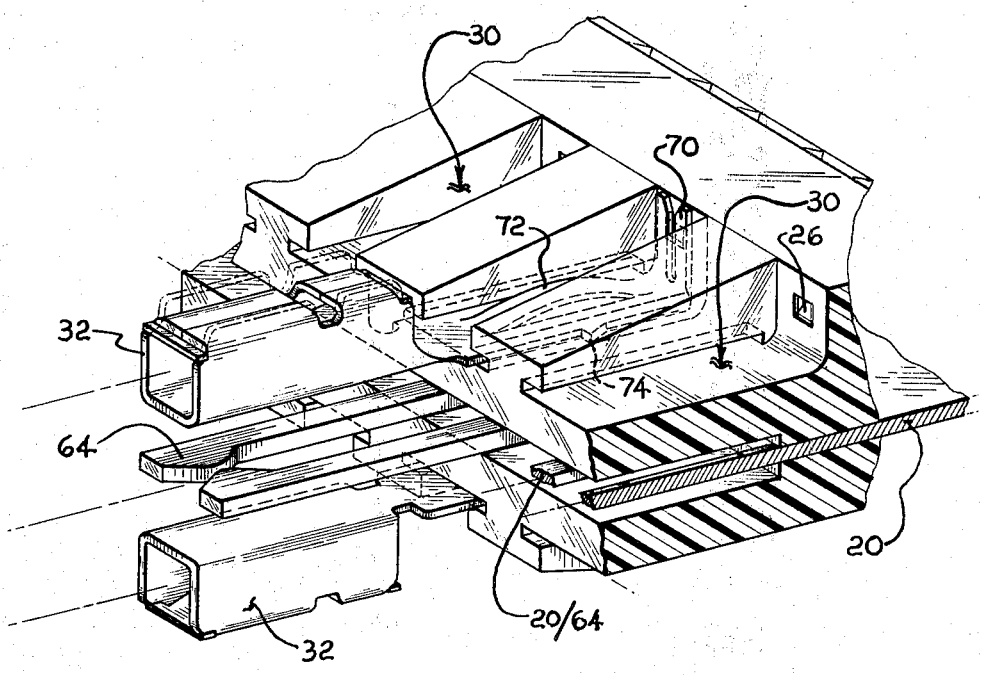
FIG. 5—Partial prospective sectional view of exit end of funnel showing terminals inserted within slots of connector.

FIG. 4 shows a typical terminal 32. A wire guide 70 receives the signal wire 12 and is soldered in zone 60. A deflection member 72 facilitates contact with the wire 12. A lance 74 retains the terminal 32 within the slot 30. A spring 76 within the terminal 32 holds the pin 16 within the terminal 32.

Figure 3A:
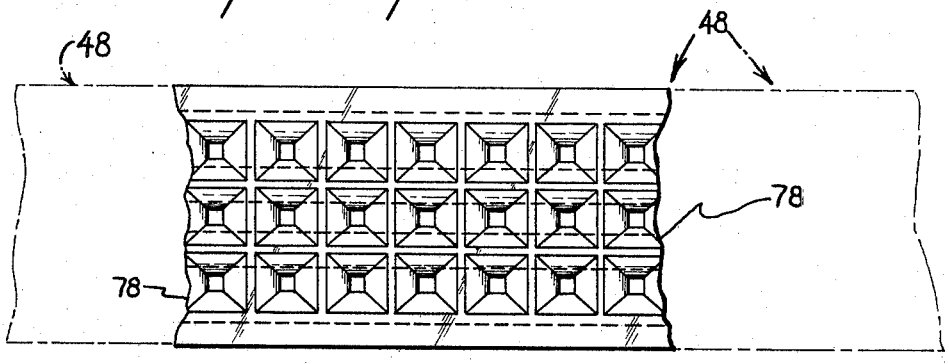
FIG. 3*a*—Partial plan view of housing front (mating surface).
Figure 3B:
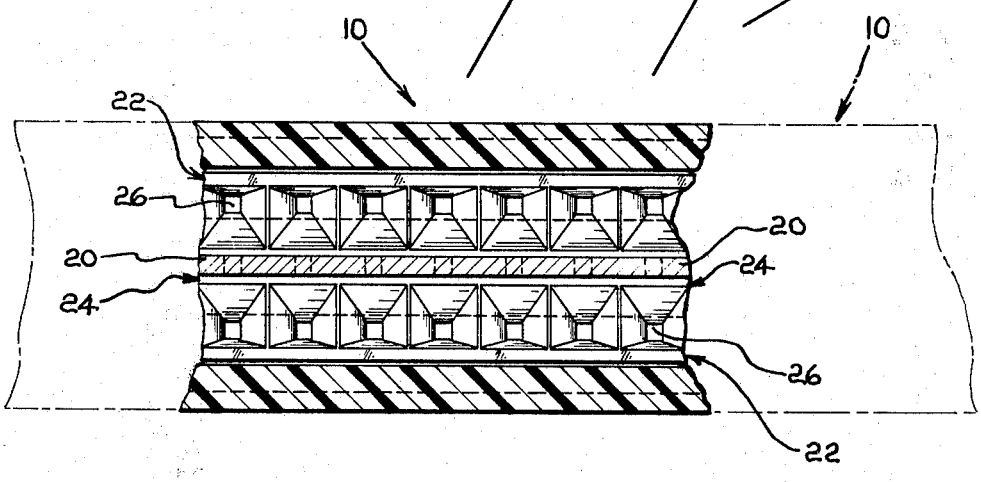
FIG. 3*b*—Sectional view just behind funnel openings without wire.

A section just behind the entrance end 24 of connector 10 is shown in FIG. 3*b*. The front 78 of the housing shell 48 is shown in FIG. 3*a*.

Figure 6:
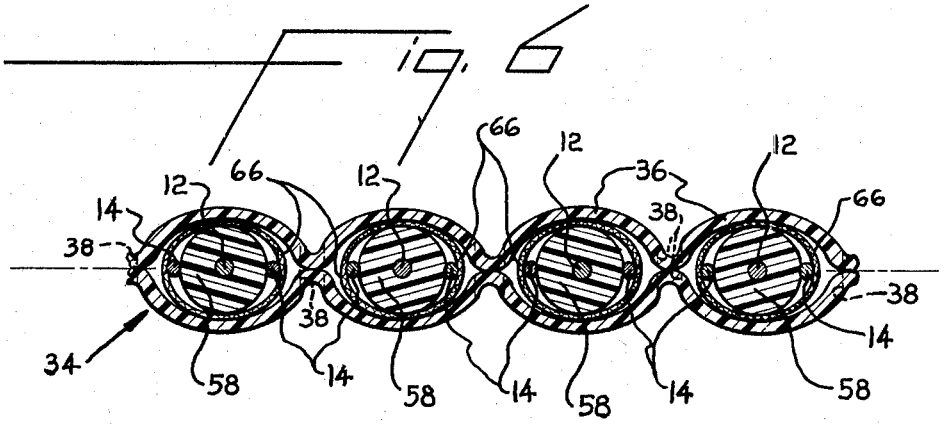
FIG. 6—Sectional view of cable.

FIG. 6 shows the aluminized MYLAR® 66 surrounded the ground or drain wires 14, the poly(tetrafluoroethylene) inner covering 58 and the signal wire 12.

Figure 7:
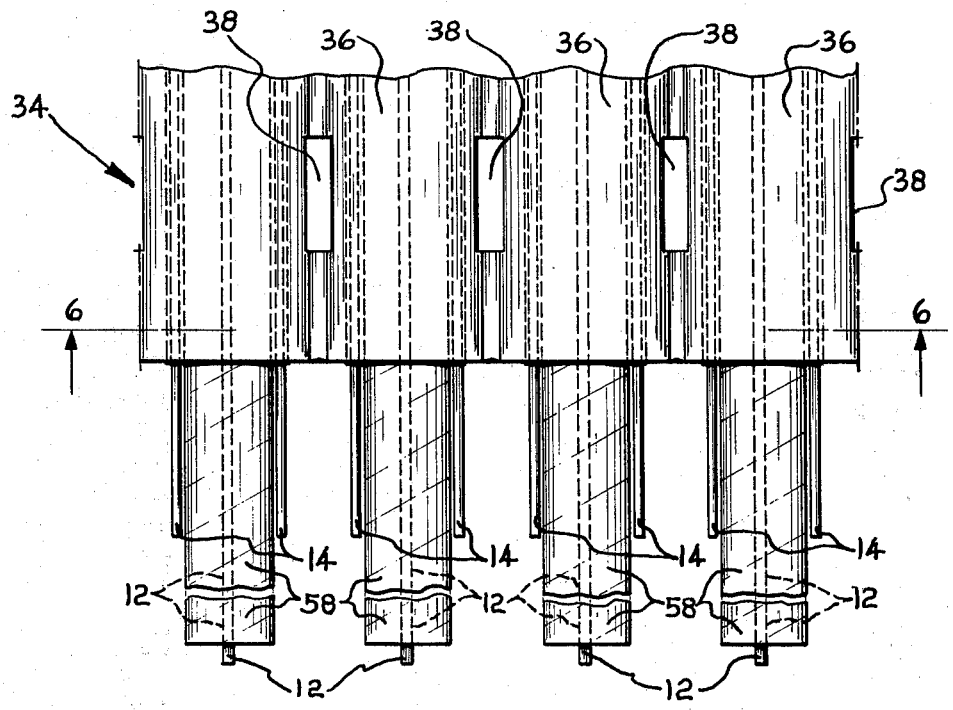
FIG. 7—Top view of partially stripped cable.
Figure 8:
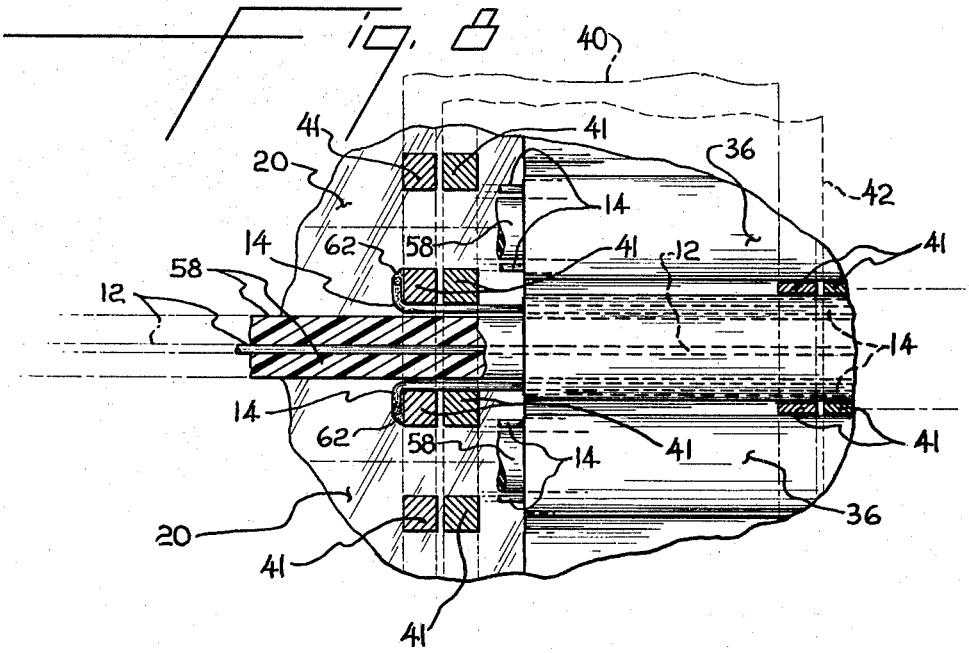
FIG. 8—Sectional top view through ground bar.

FIG. 7 shows details of the holes 38 punched into the ribbon cable 34.

The header 18 and funnel 22 can be made of any high temperature resitant plastic such as polyphenylene sulphide. The shroud 48 can be made of electric grade nylon.

The ground plate 20 and the terminal 32 can be made of electrically conductive metals such as phosphor bronze, cupro-nickel or beryllium copper.

The foregoing detailed description has been given for clearness of understanding only and no unnecessary limitations should be understood therefrom, as some modifications may be obvious to those skilled in the art.

What is claimed is:

1. An electrical connector for coax cable having repeating units of a jacket surrounding a central signal conductor and at least one drain wire exterior to said jacket, said connector comprising a metal ground plate having first and second ends and a middle portion insert molded to a dielectric member containing an entrance and exit end, said ends separated by adjacent multiple channels each having a diminishing cross sectional area beginning from said entrance end, each said jacket being retained within a channel as each signal conductor is pushed through a channel to contact an electrical terminal exterior to the exit end.

2. An electrical connector according to claim 1 wherein the ground plate is insert molded between a substantially identical pair of dielectric members containing an entrance and exit end, said ends separated by adjacent multiple channels each having a diminishing cross sectional area beginning from said entrance end, each said jacket being retained within a channel as the signal conductor is pushed through a channel to contact an electrical terminal exterior to the exit end.

3. An electrical connector according to claims 1 or 2 wherein the jacket is poly(tetrafluoroethylene).

4. An electrical connector according to claims 1 or 2 wherein a pair of drain wires are located within said cable exterior of said jacket and are soldered to said ground plate.

5. An electrical connector according to claim 2 wherein the signal wire is soldered to the terminal integral with said dielectric member.

6. An electrical connector for a pair of coax ribbon cables containing repeating units of one signal wire surrounded by a jacket and two ground wires enclosed in a metal shield, said connector comprising:

a metal ground plate having first and second ends, and a middle portion insert molded between a pair of dielectric members containing an entrance and exit end, said entrance end and exit end separated by multiple adjacent funnel shaped channels, each said channel adapted to receive a signal wire and its jacket from said coax cable, the first end of said ground plate having parallel rows of openings for receiving legs from a strain relief bar and the ground wires, the second end of said ground plate having multiple tuning forks for contacting electrical pins, the exit end of said dielectric members containing slots corresponding to the channels for receiving electrical terminals adapted to receive said signal wire exiting from each channel of said dielectric member, while each jacket is retained within a channel of said dielectric member, said strain relief bar having at least one latch for engaging a housing shell enclosing said connector.

7. An electrical connector according to claim 6 wherein said jacekt is poly(tetrafluoroethylene).

8. An electrical connector according to claim 6 wherein the dielectric members are molded from polyphenylene sulphide.

* * * * *